US006362780B1

(12) United States Patent
Butz et al.

(10) Patent No.: US 6,362,780 B1
(45) Date of Patent: Mar. 26, 2002

(54) MULTI-BEAM PHASE-ARRAY ANTENNA DEVICE

(75) Inventors: Juergen Butz; Hans-Peter Diercks, both of Aspach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/546,761

(22) Filed: Apr. 11, 2000

(30) Foreign Application Priority Data

Apr. 16, 1999 (DE) ..... 199 17 202

(51) Int. Cl.[7] ..... H01Q 3/22; H01Q 3/24; H01Q 3/26

(52) U.S. Cl. ..... 342/373; 342/157

(58) Field of Search ..... 342/373, 372, 342/157, 158

(56) References Cited

U.S. PATENT DOCUMENTS

| | | | | |
|---|---|---|---|---|
| 3,979,754 A | | 9/1976 | Archer | |
| 5,115,248 A | | 5/1992 | Roederer | |
| 5,162,803 A | * | 11/1992 | Chen | 342/372 |
| 5,488,380 A | * | 1/1996 | Harvey et al. | 342/368 |
| 5,598,173 A | | 1/1997 | Lo Forti et al. | |
| 5,745,076 A | * | 4/1998 | Turlington et al. | 342/372 |
| 5,812,088 A | | 9/1998 | Pi et al. | |
| 5,861,845 A | | 1/1999 | Lee et al. | |

FOREIGN PATENT DOCUMENTS

| | | |
|---|---|---|
| EP | 0 368 121 B1 | 11/1993 |
| EP | 0 702 424 A1 | 3/1996 |
| EP | 0 795 928 A1 | 9/1997 |
| EP | 0 651 461 B1 | 5/1998 |

* cited by examiner

*Primary Examiner*—Theodore M. Blum
(74) *Attorney, Agent, or Firm*—Michael J. Striker

(57) ABSTRACT

A multi-beam phase-array antenna device includes beam configuring devices (BFN) arranged in respective separate groups behind corresponding radiator elements (SE1 . . . SEm). In each group the beam configuring devices (BFN) are arranged one after the other along a first predetermined direction behind the associated radiator element. The number of beam configuring devices in each separate group is selected according to the number (n) of antenna signals. A signal combining device (SK) is provided for each separate group of beam forming devices (BFN). Signal distributing devices (VR1 . . . VRn) for control of the beam configuring devices are preferably mounted on the rear side of a circuit-carrying substrate (SU) for the beam configuring devices (BFN), in order to provide a compact structure. An especially compact and economical structure is provided when the transverse cross-section of each group is adjusted to the area of the associated radiator element.

24 Claims, 8 Drawing Sheets

MULTI-BEAM PHASE-ARRAY ANTENNA DEVICE

BACKGROUND OF THE INVENTION

1. Field of the Invention

The present invention relates to a multi-beam phase-array antenna device with radiator elements arranged in a matrix array, which are controllable by respective beam configuring devices.

2. Prior Art

A phase-array receiving antenna device is known from and described in EP 0 651 461 B1. In this known antenna device the radiator elements are arranged in rows and columns. The received signals from the radiator elements are collected row-wise and column-wise by means of signal combining devices and then input to a non-linear combining circuit, in order to obtain a desired preferred orientation of this receiving antenna.

EP 0 368 121 B1 discloses a receiving antenna device with radiator elements arranged in a matrix array, in which each radiating element has an amplifier and a filter. The signals received in the radiating elements are divided group-wise by means of signal distributing devices and conducted to respective beam configuring devices. The output signals from the beam configuring devices are collected to form several antenna signals by means of signal combining devices.

SUMMARY OF THE INVENTION

It is an object of the present invention to provide a multi-beam phase-array antenna device of the above-described kind, having an especially compact and economical structure.

According to the invention the multi-beam phase-array antenna device comprises

- a plurality of radiator elements arranged in a matrix array;
- to signal distributing devices corresponding in number to the number of beams received during receiving operation or transmitted during transmission operation;
- beam configuring devices for controlling the radiator elements arranged in respective separate groups behind the corresponding radiator elements, wherein the beam configuring devices in each separate group correspond in number to the number of beams received during receiving operation or transmitted during transmission operation;
- multiplex connection means for connecting the signal distributing devices with the beam configuring devices; and
- signal combining means for directly connecting the signal configuring devices in the respective separate groups to the corresponding radiator elements or for connecting the signal configuring devices to the corresponding radiator elements by means of amplifying devices and/or filter devices.

The multi-beam phase-array antenna according to the invention has a very compact structure, which can be adjusted in a flexible manner to the number of input antenna signals in the case of transmitting operation or the number of received signals in the case of receiving operation. The cross-sectional area requirements for the beam configuring devices are the same as the area of the radiator elements since the beam configuring devices are arranged behind the respective radiator elements in the corresponding separate groups. The depth of each of the separate groups is determined by the complexity of the entire system, which means especially according to the input or received antenna signals, and is variably adjustable.

The assembly of respective sets of separate groups in corresponding trough-shaped modules is especially advantageous. Only one circuit-carrying substrate, whose rear side can be used for mounting beam configuring devices, is necessary, so that no additional space is required.

Since the signal distributing devices and beam configuring devices are arranged on opposite sides of the same circuit-carrying substrate, the multiplex connection device between them is provided without additional space in the form of simple signal guides through the circuit-carrying substrate.

Because of that feature, the separate groups are separated from each other, which means that they are arranged on opposite sides of shielding walls, so that there is little interference with their respective signals despite the compact arrangement. Similarly the trough-shaped modules are formed so that they can be stacked one on top of the other, which permits a high packing density with greater flexibility. Furthermore amplifier devices and, if necessary, filter devices may be easily integrated into the separate groups and/or the trough-shaped modules. Separating walls may be used to provide thermal uncoupling. The dissipated heat, which is a continual problem in highly integrated antennas, may be easily conducted away by means of heat pipes or heat sink devices. The invention, as a whole, has a high integration density and compactness.

In a preferred embodiment the corresponding separate groups of beam configuring devices are arranged in succession linearly behind the respective radiator elements.

The antenna device according to the invention may be used preferably as a microwave antenna in the Ku/Ka band, however it is not excluded from use in other frequency bands.

BRIEF DESCRIPTION OF THE DRAWING

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
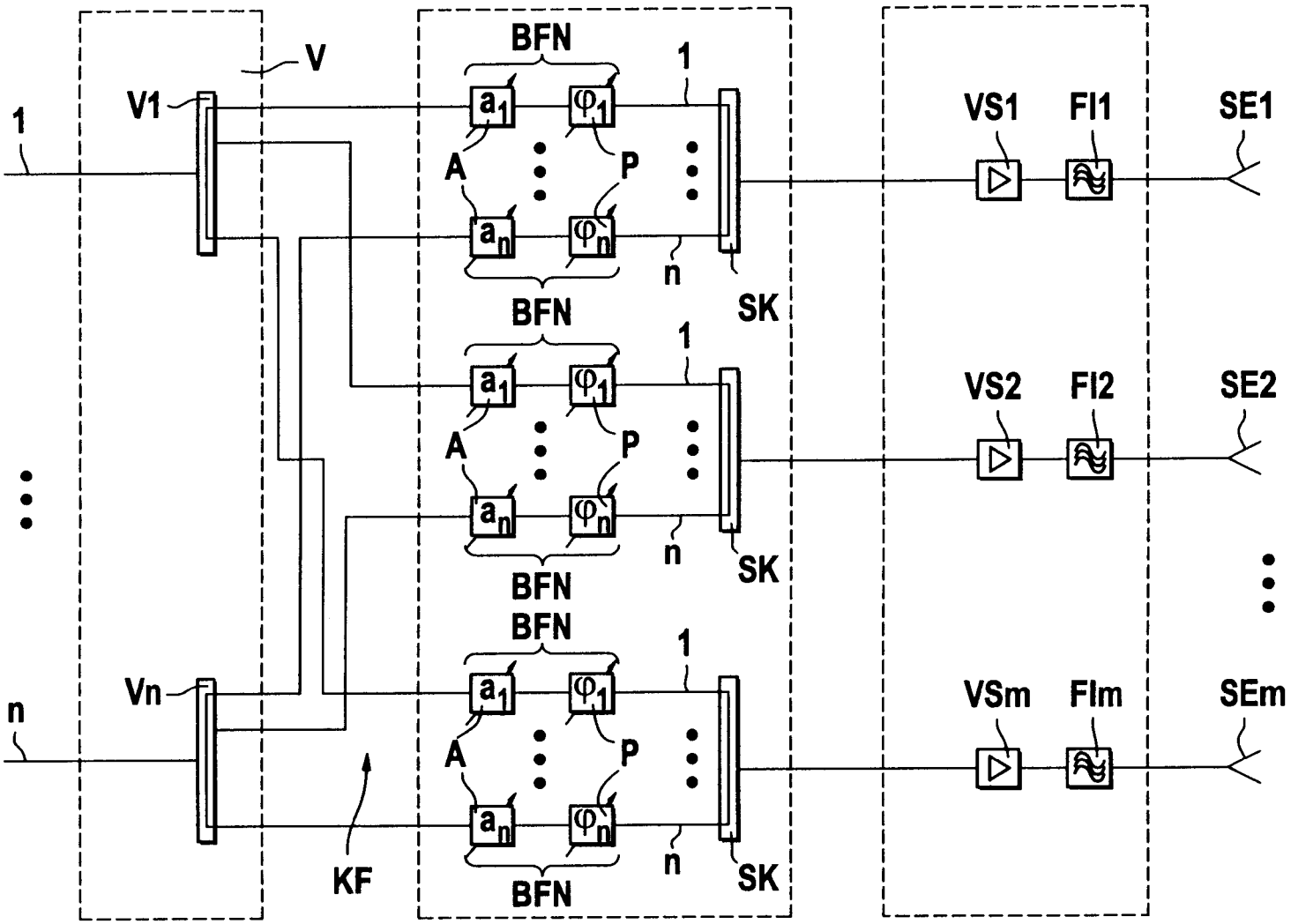
FIG. 1 is a schematic diagram of the antenna device showing the path of a signal through it.

FIG. 1 is a schematic view of a multi-beam phase-array antenna device according to the invention showing the path of a signal through it. The antenna device shown in FIG. 1 is described for use as a transmitting antenna in the following. For use as a receiving antenna the course of a signal through the antenna device is the reverse of that shown in the drawing.

N input antenna signals—the so-called beams—are provided, which are fed to respective signal distributing devices V1 to Vn. These signal distributing devices V1 to Vn are assembled in block V and divide the power of the beams into m partial signals, in order to control respective groups of n corresponding beam configuring devices BFN. Each of the m outputs of the respective signal distributing devices V1 to Vn are connected to a corresponding beam configuring device BFN by means of a multiplex connector KF. Altogether m·n beam configuring devices are provided, which each comprise active amplitude regulator A and phase regulator P and an intervening amplifier (which is not shown in FIG. 1). These intervening amplifiers can also be used at the same time as amplitude regulators A. The adjusting components or regulators are usually provided by one or more MMIC circuit devices (Monolithic microwave integrated circuit). Several phase regulators and/or amplitude regulators can, for example, be accommodated in a single MMIC. The m subgroups of the n respective beam configuring devices are combined by means of corresponding signal combining devices SK. The signal combining devices SK are coupled either directly to respective radiator elements SE1 . . . SEm, or, as in the embodiment shown in FIG. 1, indirectly to them by means of corresponding power amplifiers VS1 to VSm (SSPA=solid state power amplifier) and filter devices FI1 . . . FIm shown connected in series with power amplifiers between them and the signal combining devices. Alternatively, the filter devices may be connected between the power amplifiers and the radiator elements.

Alternatively a LNA (low noise amplifier) and input filter are required in another embodiment for reception operation instead of the transmitting amplifiers or power amplifiers.

In the embodiment according to FIG. 1 each radiator element SE1 . . . SEm may be supplied from each of the n input antenna signals (beams). In order to keep the construction of the multi-beam phase-array antenna as economical and compact as possible, the cross-sectional areas of the beam configuring networks BFN, according to the embodiment of FIG. 2 of the invention, are adjusted to the corresponding areas of the radiator elements on the front surface of the antennas. The depth of the groups of beam configuring networks BFN is variable and depends on the number n of the beam configuring devices BFN in each group. The active components A and P for the beam configuring and the amplifiers VS1 . . . VSm and filter devices FI1 . . . FIm are arranged in a group (channel) perpendicular to the front surface behind the radiator elements SE1 . . . SEm.

Figure 2:
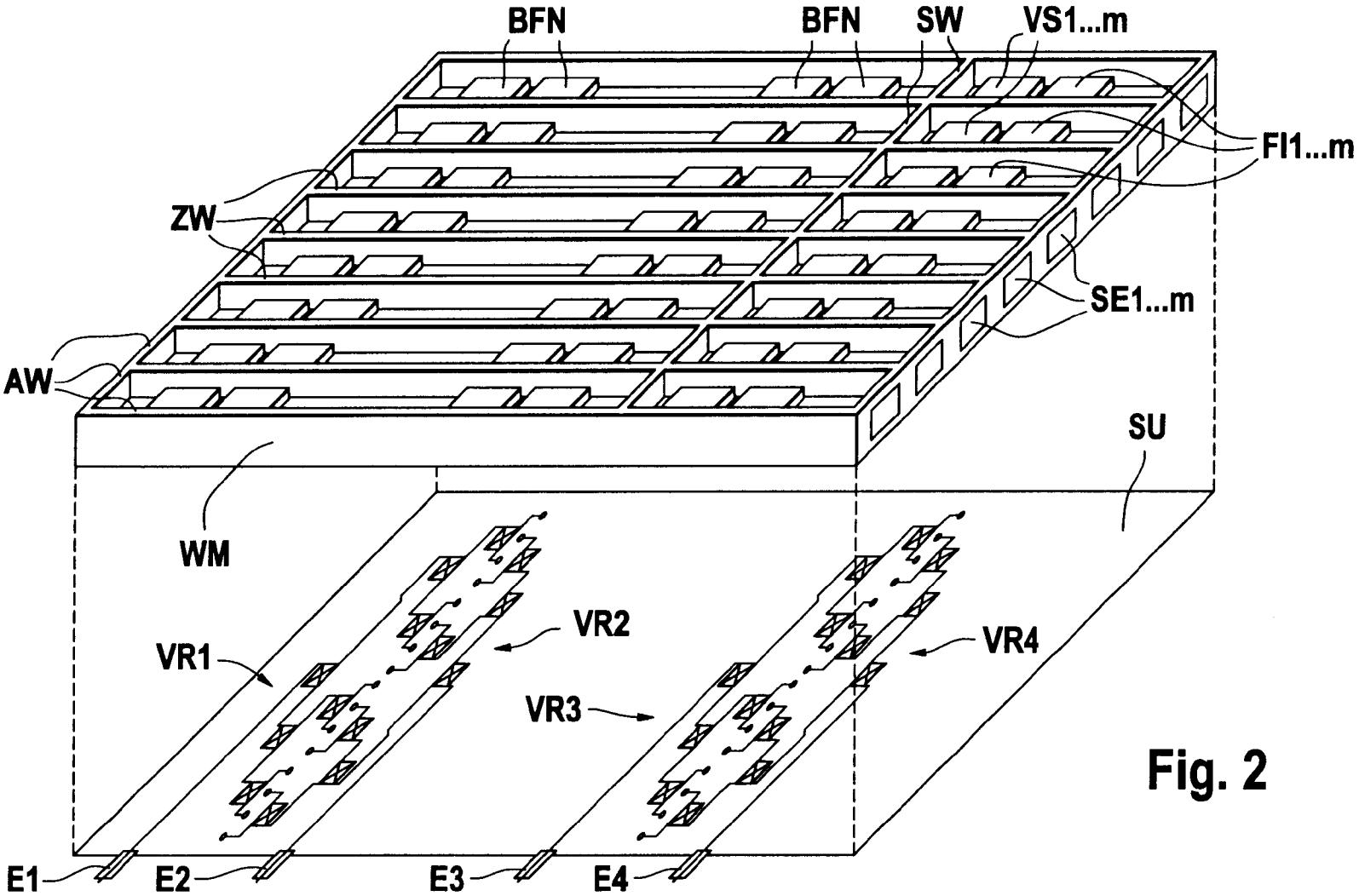
FIG. 2 is a perspective illustration of a part of the antenna device with eight regions of beam configuring devices and four input antenna signals.
Figure 3:
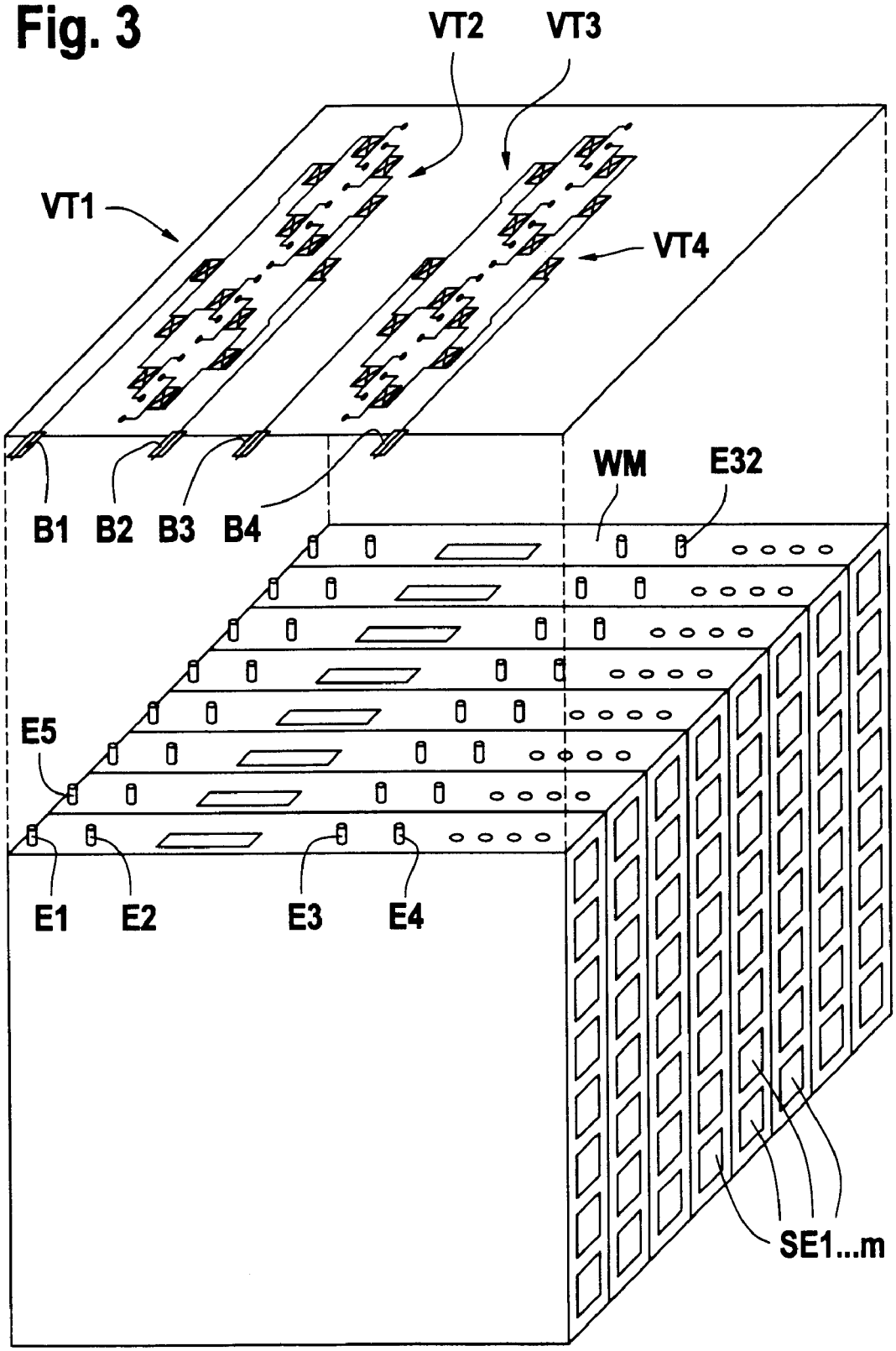
FIG. 3 is a perspective view of trough-shaped modules of the antenna device stacked over each other.

The number of groups (channels) is identical with the number m of radiator elements (SE1 . . . SEm). The number of active beam configuring components BFN per group (channel) is identical with the number of antenna signals (beams). Altogether men active beam configuring components are necessary. In the embodiment shown in the drawing the groups (channels) of beam configuring devices BFN are arranged row-wise and column-wise. In FIG. 2 one of the rows for m=8 separate groups of beam configuring devices is shown. A mechanical assembly of separate groups of beam configuring devices BFN, which are arranged in a plane (in rows), is provided in each trough-shaped module WM. In each module WM the groups are separated by intervening walls ZW both mechanically and electrically (shielded wall function) and also to provide heat conduction. The groups (channels) are likewise protected electrically and mechanically from the exterior by outer walls AW. In an additional embodiment the amplifier and filter devices VS1 . . . VSm and/or FI1 . . . FIm are arranged in trough-shaped modules WM. The electrical and mechanical separation and also the thermal uncoupling of the beam configuring devices BFN occurs by means of an additional shielding wall SW. The trough-shaped modules WM are constructed so as to be stackable over each other. Several trough-shaped modules WM, eight in the embodiment according to FIG. 3, are stacked over each other, until the number m=64 for the radiator elements SE1 . . . SE64 is reached.

Figure 4:
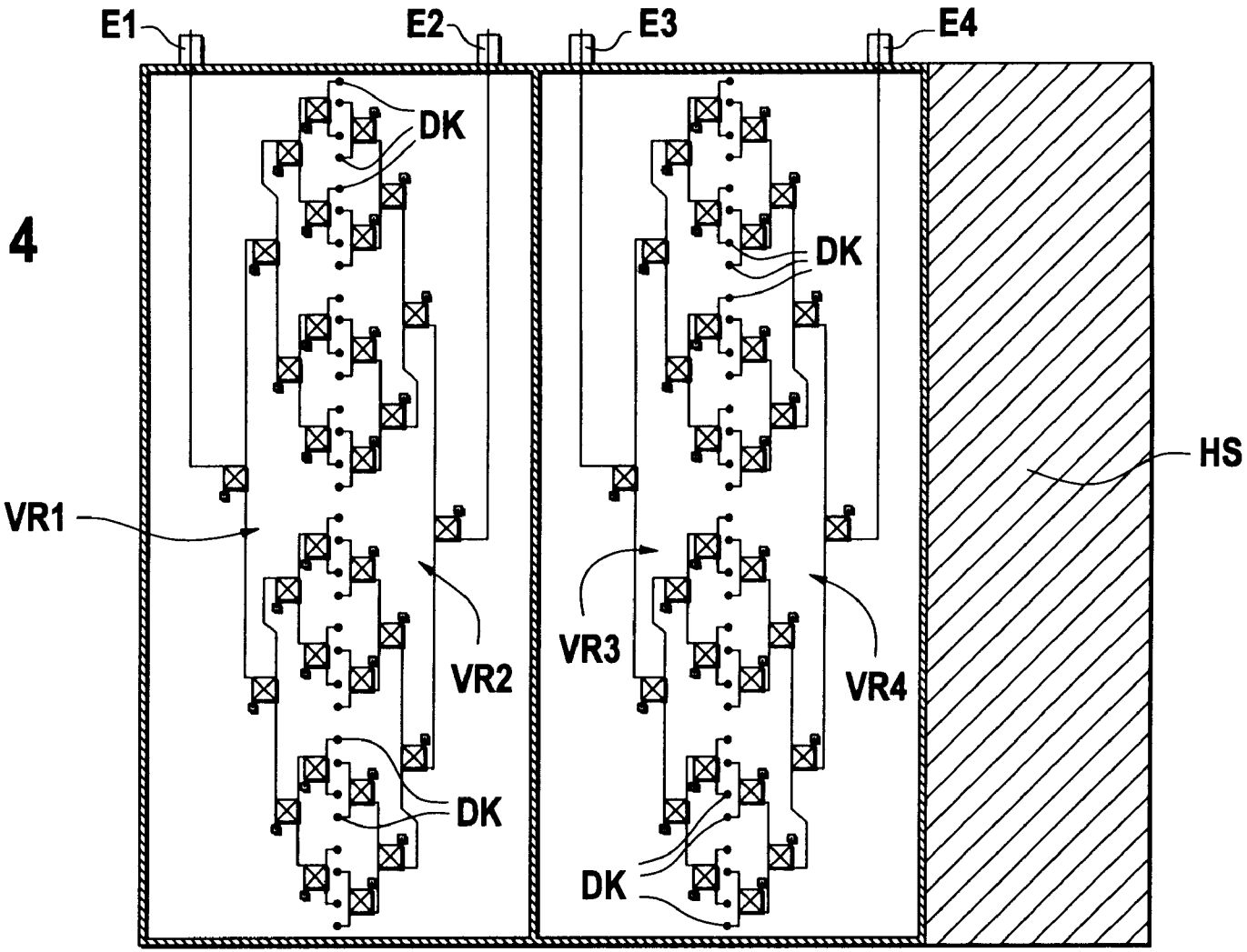
FIG. 4 is a schematic view of a signal distributing device for four antenna signals (beams), arranged on the rear side of the circuit-carrying substrate for the respective beam configuring devices.

As shown in FIG. 3, the trough-shaped modules WM stacked over each other form a symmetrical stable antenna block, which is shielded on all sides. The trough-shaped modules WM each have a circuit-carrying substrate SU, which has on a rear side thereof at least a part of the n signal distributing devices/power dividing networks V1 . . . V4. In FIGS. 2 and 4 these networks are indicated with VR1 . . . VR4. The upper side of the circuit-carrying substrate SU carries the conducting structures for the active beam configuring devices BFN. The signal conduction orthogonal to the channel direction of the conducting structures on the rear side of the circuit-carrying substrate SU is very essential for the compact structure of the antenna device, since the embodiment of the multiplex connector KF shown in FIG. 1 can be in the simple form of signal guides DK (FIG. 4) in the circuit-carrying substrate SU between the conducting structures for the beam configuring devices BFN, on the one hand, and the conducting structures for the signal distributing devices, on the other hand. In the embodiment shown in FIG. 4, in contrast to that in FIG. 2, the signal distributing devices VR1 . . . VR4 are designed for m=16 groups. The cascading of respective seven 3-dB power dividers in strip line technology, for example the cascaded Wilkinson divider as in FIG. 2, is another possible embodiment of the signal distributing devices VR1 to VR4.

The 4×8 inputs to the eight trough-shaped modules WM stacked over each other are conducted to the terminals E1 . . . E32 on a lateral side of the block of the antenna device as shown in FIG. 3. These inputs are connected to the four beam inputs B1 to B4 by means of four further 1-to-8 power-distributing networks VT1 . . . VT4, which are likewise components of the signal distributing devices V1 to V4 shown in FIG. 1. FIG. 3 shows the antenna device for eight modules WM stacked over each other and four beams. The structure and dimensions of the power-distributing networks VT1 . . . VT4 can preferably be identical to the signal distributing devices VR1 . . . VRn on the rear side of the circuit-carrying substrate SU.

Figure 5:
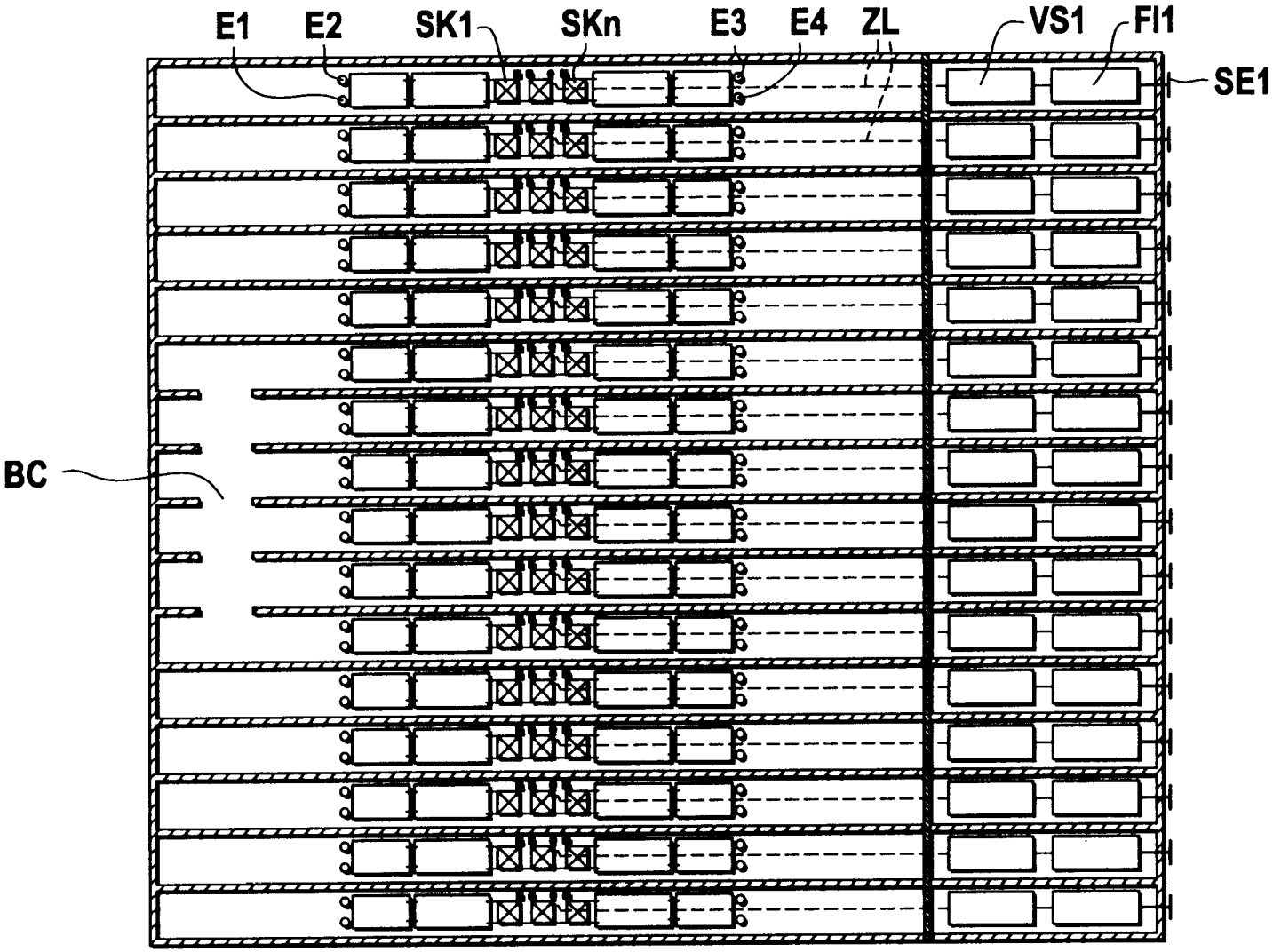
FIG. 5 is a longitudinal cross-sectional view through the regions of the beam configuring devices.
Figure 6:
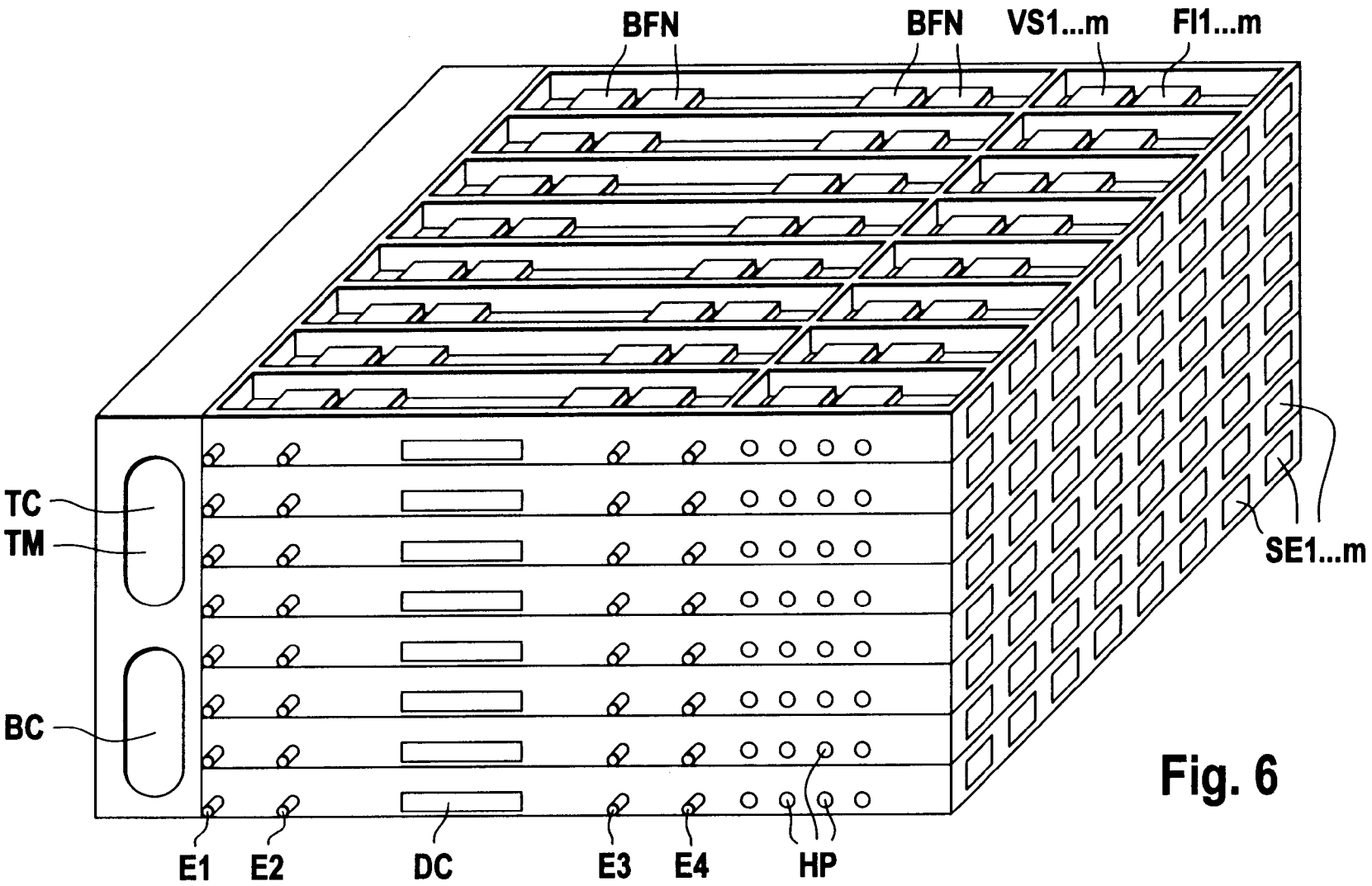
FIG. 6 is a perspective view of the antenna device according to the invention with additional devices mounted on its side.
Figure 7:
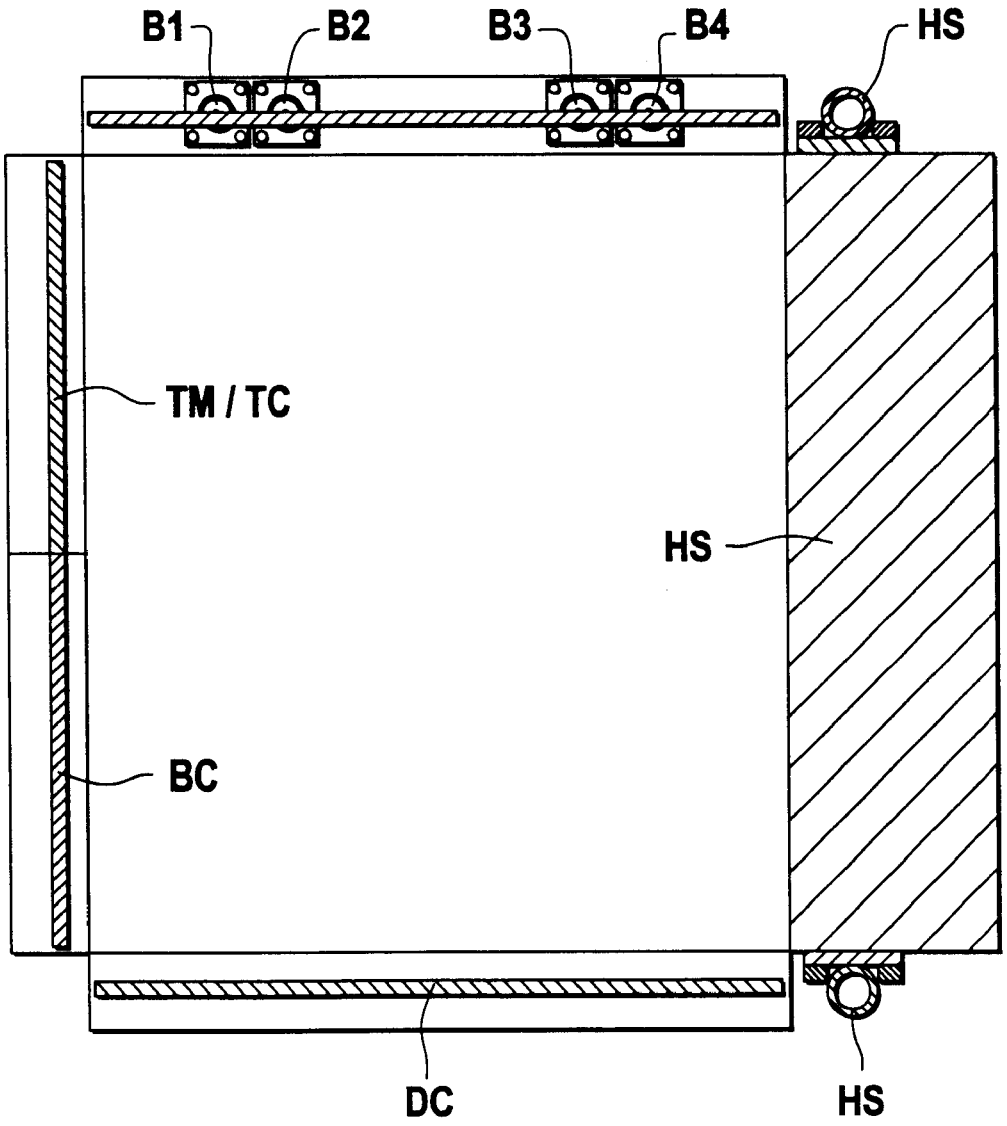
FIG. 7 is a longitudinal cross-sectional view through the additional devices shown in FIG. 6.

In FIG. 5 a longitudinal cross-sectional view through the groups of the beam configuring devices BFN is shown. According to FIG. 4 m=16 groups per trough-like module M are provided. The outputs of the active components of the beam configuring devices BFN are combined by respective signal combining devices SK, which means by respective power adding networks. In the embodiment shown n=4 output signals per group (channel) are combined. Cascaded 3-dB Wilkinson divider/combiner devices SK1 . . . SKn may be used to accomplish this. Altogether 16×4-to-1 power adding networks are required for each of the 16 trough-shaped modules. The active components of the beam configuring devices and the power adding networks may be kept small and thus the spatial requirements for the beam configuring devices BFN may also be kept small. The principal arrangement is shown in FIG. 5. In each group four RF inputs are provided, which are connected to the inputs B1 . . . B4 for the beams by means of the signal distributing devices VT1 . . . VT4. The four inputs E1 . . . E4 are guided to the power adding-signal combining devices SK1 . . . SK4, in the center of the channel, by the space-saving geometric arrangement, especially the to arrangement of the respective n=4 beam configuring components inside a group (channel). The common output is connected with the power amplifiers VS1 . . . VSm by means of the conductors ZL indicated with dashed lines in FIG. 5. Additional components for the antenna device according to the invention are shown in FIG. 6. These additional components include lateral signal inputs BC for control of the beam configuring devices (beam control), telemetry devices TM and telecommand devices TC, as well as the DC inputs for current supply of the entire antenna arrays. There are different possible arrangements for supply of these control and/or supply signals, i.e. multi-layer conductor strip arrangements in the circuit-carrying substrate SU.

A through-going heat sink device HS or heat pipe device HP, which conducts the dissipated heat from the trough-shaped modules WM to the lateral sides of the antenna device, is arranged in the trough-shaped modules WM under the power amplifier zones to conduct away the dissipated heat.

Figure 8:
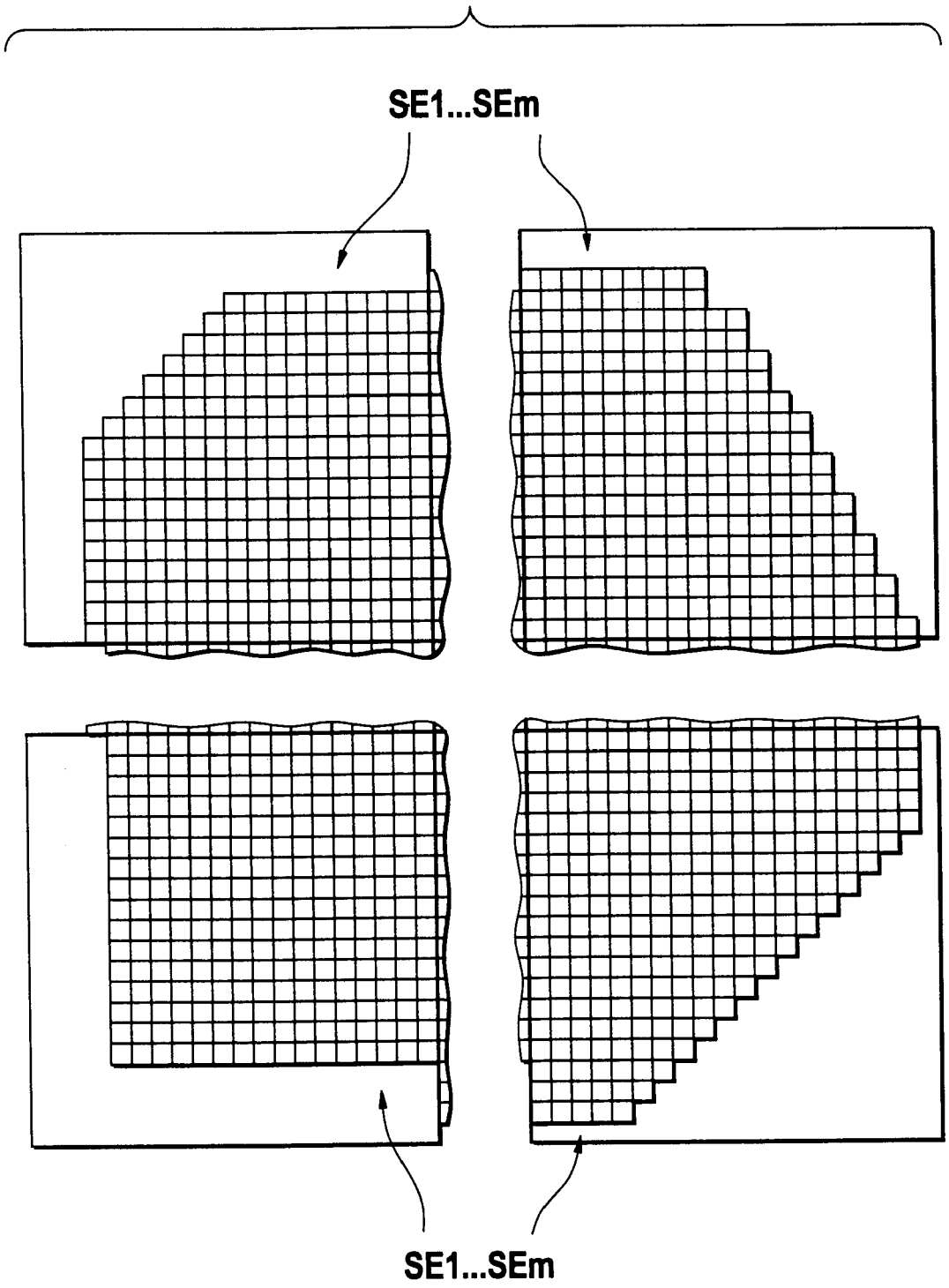
FIG. 8 is a plan view of an antenna array with active radiator elements in different quadrants.

The compromise between pivot angle of the antenna side lobe separation and dimensions of the array requires that the radiator elements be arranged in a square, a hexagon, an ellipse or a polygon. These embodiments can be provided by a plurality of differently equipped rows in the trough-shaped modules. FIG. 8 shows different possible arrangements (respective quadrants) of the active radiator elements. All arrangements are compatible with the previously described structure. In FIG. 8 only one antenna array with 36×36 radiator elements is shown. The arrangement of the radiator elements under each other can be either a rectangular row/column array or a hexagonal structure. By opposing displacements of the trough-shaped modules WM by about a half radiator element spacing both structures can be attained. Also other arrays, e.g. with m=1024 radiator elements and n=4 beam can of course be provided. The radiator elements are arranged completely equipped in a matrix of 32 columns×32 rows or in a hexagonal structure.

The disclosure in German Patent Application 199 17 202.1 of Apr. 16, 1999 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a multi-beam phase-array antenna device, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A multi-beam phase-array antenna device comprising a plurality (m) of radiator elements (SE1 . . . SEm) arranged in a matrix array;

a plurality of signal distributing devices (V1 . . . Vn) corresponding in number to the number (n) of beams received during receiving operation or transmitted during transmission operation;

beam configuring devices (BFN) for controlling the radiator elements arranged in succession one behind the other in respective separate groups extending in a first predetermined direction behind corresponding individual ones of the radiator elements, wherein the beam configuring devices (BFN) in each of said groups correspond in number to the number (n) of beams received during receiving operation or transmitted during transmission operation;

multiplex connection means (KF) for connecting the signal distributing devices (V1 . . . Vn) with the beam configuring devices (BFN); and signal combining means (SK) for directly connecting the beam configuring devices (BFN) in said respective separate groups to the corresponding radiator elements (SE1 . . . SEm) or for connecting the beam configuring devices (BFN) to the corresponding radiator elements (SE1 . . . SEm) by means of amplifying devices (VS1 . . . VSm) and filter devices (FI1 . . . FIm).

2. The antenna device as defined in claim 1, further comprising trough-shaped stackable modules (WM), each of said troughhaped stackable modules comprising a separate set of said respective separate groups of the beam configuring devices (BFN).

3. The antenna device as defined in claim 2, wherein said trough-shaped stackable modules (WM) are stacked one over the other in another predetermined direction to form a symmetric block of said beam configuring devices (BFN).

4. The antenna device as defined in claim 3, wherein said another predetermined direction is perpendicular to said first predetermined direction.

5. The antenna device as defined in claim 3, wherein the beam configuring devices (BFN) in said respective separate groups are connected to the corresponding radiator elements (SE1 . . . SEm) by means of the amplifying devices (VS1 . . . VSm) and the filter devices (FI1 . . . FIm), the amplifying devices are power amplifiers and the amplifying devices (VS1 . . . VSm) and the filter devices (FI1 . . . FIm) are arranged in said trough-shaped stackable modules.

6. The antenna device as defined in claim 5, wherein said trough-shaped stackable modules (WM) comprise shielding walls (ZW) and said shielding walls (ZW) separate said respective separate groups of the beam configuring devices (BFN) from each other.

7. The antenna device as defined in claim 5, wherein said trough-shaped stackable modules (WM) comprise additional shielding walls (SW) and said additional shielding walls (SW) separate the amplifying devices (VS1 . . . VSm) and the filter devices (FI1 . . . FIm) from the beam configuring devices (BFN) within each of said trough-shaped stackable module (WM).

8. The antenna device as defined in claim 3, wherein respective circuit-carrying substrates (SU) are arranged in the trough-shaped stackable modules (WM), said respective circuit-carrying substrates have conducting structures for the beam configuring devices (BFN) on one substrate side of each of the substrates and other conducting structures for at least part of the signal distributing devices (V1 . . . Vn) on another substrate side of each of said substrates opposite from the one substrate side.

9. The antenna device as defined in claim 8, wherein said other conducting structures are orthogonal to said conducting structures.

10. The antenna device as defined in claim 8, wherein said multiplex connection means (KF) comprises signal guides provided in said respective circuit-carrying substrates (SU) of said trough-shaped stackable modules (WM) to connect said conducting structures and said other conducting structures.

11. The antenna device as defined in claim 1, wherein said signal combining means (SK) is arranged in a middle portion of each of said respective separate groups of said beam configuring devices (BFN).

12. The antenna device as defined in claim 8, wherein said trough-shaped stackable modules (WM) have inputs (E1 . . . E32) for said at least part (VR1 . . . VR4) of the signal distributing devices on said another side of said respective circuit-carrying substrates (SU) and said inputs (E1 . . . E32) are arranged on a lateral side of said symmetric block and said inputs (E1 . . . E32) are connected to terminals (B1 . . . B4) for the antenna signals received during receiving operation or transmitted during transmission operation by means of an additional part (VT1 . . . VT4) of said signal distributing devices and said signal combining means (SK) is arranged in a middle portion of each of said separate groups of said beam configuring devices (BFN).

13. The antenna device as defined in claim 1, wherein the signal distributing devices (V1 . . . Vn) or the signal combining devices (SK) comprise 3-dB power dividing devices, each of the 3-dB power dividing devices comprises a number of cascaded stages and the number of said cascaded stages is selected according to the number (n) of beams received during receiving operation or transmitted during transmission operation or according to the plurality of said radiator elements (SE1 . . . SEm), or both the signal distributing devices (V1 . . . Vn) and the signal combining devices (SK) comprise said 3-dB power dividing devices.

14. The antenna device as defined in claim 13, wherein the 3-dB power dividing devices are provided by strip line technology.

15. The antenna device as defined in claim 1, wherein the beam configuring devices (BFN) each comprise a phase regulator (P) and an amplitude regulator (A).

16. The antenna device as defined in claim 15, wherein the beam configuring devices (BFN) each comprise an intervening amplifier acting as an amplitude controller.

17. The antenna device as defined in claim 15, further comprising a monolithic microwave integrated circuit and wherein at least one of said phase regulator (P) and at least one of said amplitude regulator (A) are part of said monolithic microwave integrated circuit.

18. The antenna device as defined in claim 3, wherein said symmetric block of said beam configuring devices (BFN) includes signal inputs (BC) for adjustment of the beam configuring devices (BFN) and a current supply and said signal inputs (BC) are arranged on a side of said symmetric block.

19. The antenna device as defined in claim 3, further comprising a heat pipe device (HP) or a heat sink device (HS) in the vicinity of the amplifying devices (VS1 . . . VSm) extending in a further predetermined direction perpendicular to said respective groups of beam configuring devices (BFN) and arranged so that heat from the trough-shaped modules (WM) is conducted away to one side of said symmetric block of said trough-shaped stackable modules (WM).

20. The antenna device as defined in claim 1, wherein said respective separate groups of said beam configuring devices (BFN) each have a transverse cross-section, said transverse cross-section corresponds to an area of said corresponding radiator element and said respective groups of said beam configuring devices each have a length and said length is selected according to the number (n) of beams received during receiving operation or transmitted during transmission operation.

21. The antenna device as defined in claim 2, wherein said respective groups of said trough-shaped stackable modules (WM) are arranged differently in order to obtain a predetermined arrangement of cooperating active radiator elements (SE1 . . . SEm).

22. The antenna device as defined in claim 21, wherein said predetermined arrangement is in the form of a rectangle, a hexagon, an ellipse or a polygon.

23. The antenna device as defined in claim 21, wherein said predetermined arrangement is a rectangular row and column array.

24. The antenna device as defined in claim 21, wherein said predetermined arrangement is a hexagonal structure and said hexagonal structure is provided by a displacement of said respective groups, or said trough-shaped modules (WM) receiving said respective groups, with respect to each other by about half an edge length of one of said radiator elements.

* * * * *